US005275575A

United States Patent [19]

Cahaly et al.

[11] Patent Number: 5,275,575

[45] Date of Patent: Jan. 4, 1994

[54] ELECTRICAL CONNECTION SYSTEM WITH SAFETY INTERLOCK

[75] Inventors: James E. Cahaly, Milford, N.H.; Brian R. Pitstick, Mesa, Ariz.

[73] Assignee: TRW Inc., Cleveland, Ohio

[21] Appl. No.: 960,477

[22] Filed: Oct. 9, 1992

[51] Int. Cl.[5] ..... H01R 13/703

[52] U.S. Cl. ..... 439/188; 200/51.1; 439/352; 439/510; 439/680

[58] Field of Search ..... 439/188, 189, 352, 507-514, 439/680; 200/51.1

[56] References Cited

U.S. PATENT DOCUMENTS

| | | | |
|---|---|---|---|
| 3,370,140 | 2/1968 | Betts | 200/51.1 |
| 3,467,940 | 9/1969 | Wallo | 439/188 |
| 3,512,043 | 5/1970 | Jaaksoo et al. | 200/51.1 |
| 3,912,889 | 10/1975 | Bright | 200/51.1 |
| 4,070,557 | 1/1978 | Ostapovitch | 439/188 |
| 4,106,074 | 8/1978 | Conne | 361/248 |
| 4,170,939 | 10/1979 | Hoheisel et al. | 200/51.1 |
| 4,271,453 | 6/1981 | Yajima et al. | 361/248 |
| 4,358,135 | 11/1982 | Tsuge et al. | 200/51.1 |
| 4,369,707 | 1/1983 | Budde | 102/202.2 |
| 4,906,203 | 3/1990 | Margrave et al. | 439/188 |
| 4,988,307 | 1/1991 | Muzslay | 439/188 |

OTHER PUBLICATIONS

IBM Technical Disclosure Bulletin, vol. 7, No. 6 of Nov., 1964.

*Primary Examiner*—Neil Abrams

*Attorney, Agent, or Firm*—Fay, Sharpe, Beall, Fagan, Minnich & McKee

[57] ABSTRACT

An electrical connection system comprises a first component carrying a pair of male connector elements releasably mated with a pair of female connector elements carried by a second connector component. A shorting clip is associated with the first component for providing an electrical short between the male connector elements. A safety latch is selectively receivable in a latch position for moving the shorting clip to a non-shorting position when the first component is mated with the second component and a lock element is arranged to be actuated by the safety latch to prevent separation of the first and second components while the safety latch is in the latch position.

17 Claims, 5 Drawing Sheets

ELECTRICAL CONNECTION SYSTEM WITH SAFETY INTERLOCK

BACKGROUND OF THE INVENTION

The subject invention is directed toward the art of electrical connection systems and, more particularly, to an electrical connector arrangement wherein the electrical contacts of one component are shorted together when proper electrical connection to a second component has not been made.

The invention is particularly suited for use in vehicle occupant inflatable restraint ("airbag") systems and will be described with reference thereto; however, the invention is capable of broader application and could be used in many different environments and for a variety of purposes.

Vehicle inflatable restraint, or "airbag", systems each include an airbag assembly mounted in a hidden compartment within the cab of the vehicle and an electrical or electronic control system. The control system is connected to the airbag assembly by means of a wiring harness which typically is provided with an electrical plug and jack connector arrangement to permit an easy method of electrically joining the airbag assembly and the control system after they have been installed separately.

U.S. Pat. Nos. 4,988,307 (Muzslay), 4,906,203 (Margrave, et al.), 4,369,707 (Budde), and 4,170,939 (Hoheisel, et al.) each discloses a connection system for use in an airbag system. Each connection system incorporates a so-called shorting clip. Shorting clips are small metal elements arranged to electrically short together the leads within the plug or jack before the plug and jack are mated. Such shorting clips are included as a safety feature, to preclude stray electrical charges and inadvertent misconnections from accidentally triggering the airbag assembly during the manufacturing process.

SUMMARY OF THE INVENTION

The subject invention provides a connection system of the general type described that is compact in design and includes a safety latch that is integral to the connection system and which not only locks the connection components in the connected condition to prevent inadvertent disconnection, but also prevents activation of the system until the safety latch is fully engaged. Moreover, the portion of the system which carries the shorting element acts to guide, polarize, and provide anti-rotation of the connector housing.

In accordance with the invention, an electrical connection system is provided that includes a first component carrying a male connector element. A second component is releasably mated with the first component and carries a female connector element engaged with the male connector element. Associated with the first and second components is a shorting element for shorting the male connector element and a safety latch element is provided that is receivable in a latch position for moving the shorting element to a non-shorting position when the second component is mated with the first component. Additionally, lock means are provided for preventing separation of the first and second components while the safety latch element is in the latch position. The lock means are actuated by the movement of the safety latch element to the latch position.

Preferably, the lock means includes a lock element formed on the second component. The lock element is adapted to be moved into locking engagement with the first component when the safety latch element is in its latch position.

As is apparent from the foregoing, the safety latch element is interrelated with the electrical connection system such that the system cannot be activated or disconnected when the safety latch element is in its latch position. Only after the safety latch element is in position and the components firmly locked together is the shorting element moved to a non-shorting position.

Preferably, and in accordance with a more limited aspect of the invention, the first component carries a pair of male connector elements, and the shorting element comprises a clip which at least partially encircles the pair of connecting elements to provide an electrical short therebetween. The safety latch element includes an elongated tab portion which is adapted to engage the resilient clip and move it out of contact with at least one of the male connector elements.

Accordingly, as can be seen from the foregoing, a primary object of the invention is the provision of an electrical connection system wherein a safety latch element acts to interlock the mated components and prevent actuation of the electrical connection until both components are in their full mated position and the latch element has been moved to its latch position.

A further object of the invention is the provision of a connection system of the general type described wherein a latch element is an integral part of the connection system and functions to disconnect the short element only after full mechanical and electrical connection has taken place between the components.

A further object of the invention is the provision of an electrical connection system wherein a shorting element serves to guide the mating first and second components while also assuring proper polarization and providing anti-rotation to the components.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1:
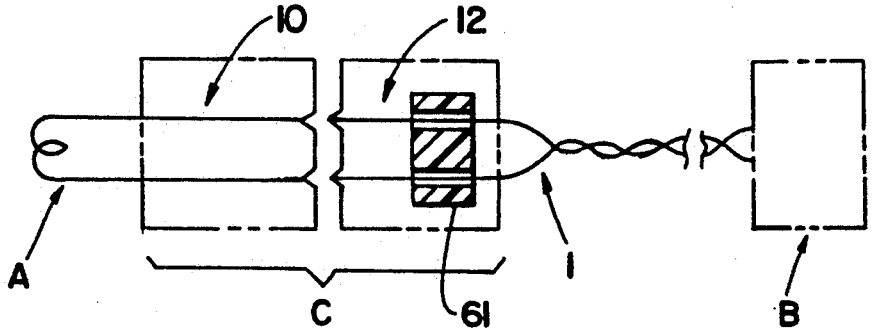
FIG. 1 is an electrical schematic of a vehicle occupant restraint system.

Referring more particularly to the drawings wherein the showings are for the purpose of illustrating a preferred embodiment of the invention only, and not for the purpose of limiting same, FIG. 1 is a general electrical schematic of a vehicular occupant restraint system in which the connector of the present invention will find utility. As shown in this FIGURE, the system comprises an airbag igniter A (sometimes referred to as a squib) which must be electrically coupled to a control system B. The igniter A is a pyrotechnic device which will combust when sufficient electrical energy is applied to it via its two electrical leads. Combustion of the igniter causes ignition of a gas generant material and consequent deployment of the airbag.

The control system is an arrangement of mechanical, electrical, and/or electronic elements designed to discern when the airbag should be deployed, and to then promptly apply electrical energy to the igniter to initiate the deployment. Electrical energy is coupled between the control system and the igniter via a pair of wires 1 and a connector system 0. The connector system 0 includes plug and jack components which may be mated to complete the electrical connection between the wires 1 and igniter A.

Figure 1A:
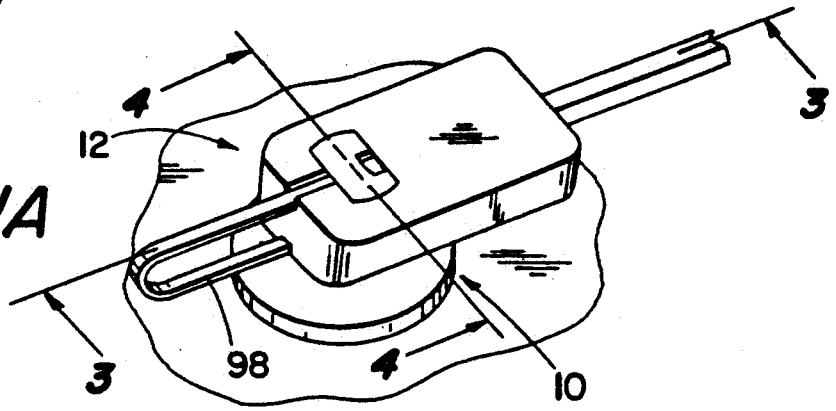
FIG. 1A is an isometric view showing the connector system of the invention in its full connected and activated condition.
Figure 2:
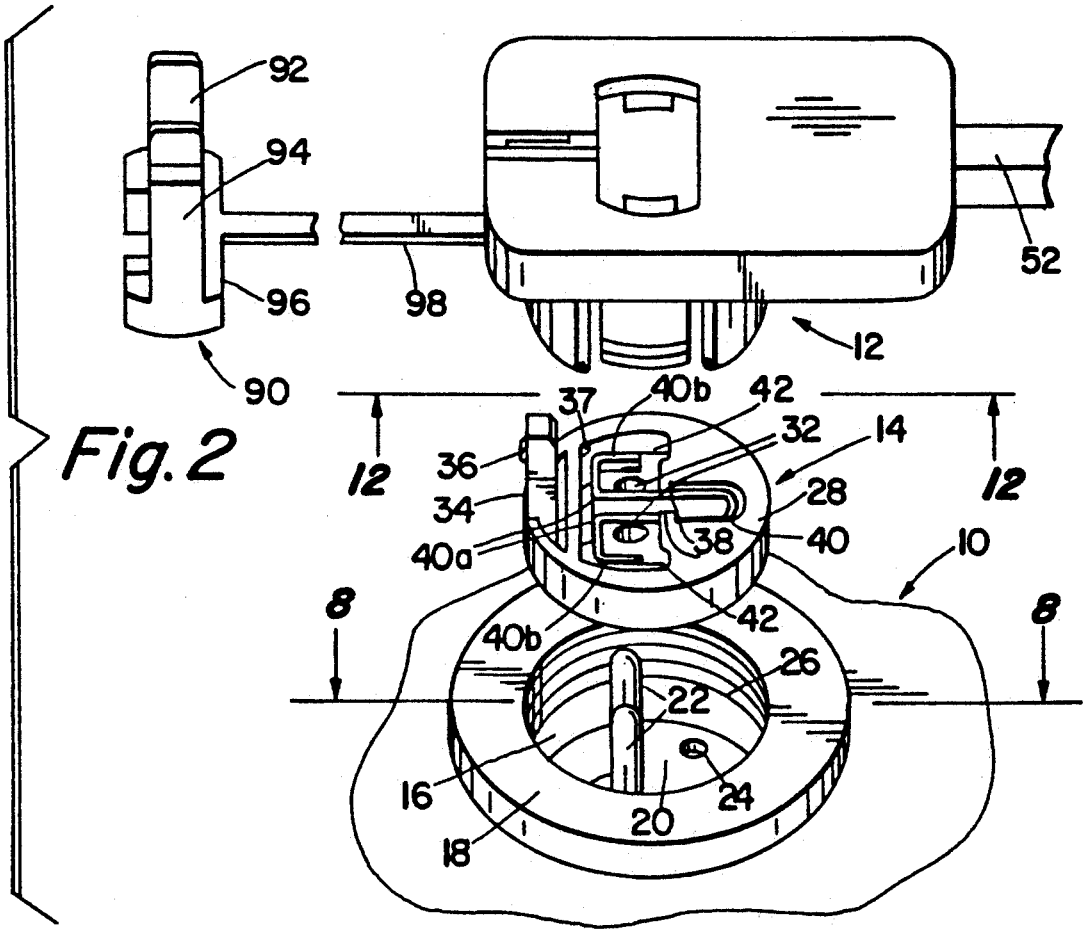
FIG. 2 is a pictorial or isometric view showing the various components of the system in their relative position, but disconnected.

FIGS. 1A and 2 show in detail the overall arrangement of the connector system of the subject invention. FIG. 1 illustrates the system in a connected and mated condition and comprising a first component 10 in the form of a jack to which is releasably mated and connected a second component 12. As seen in FIG. 2, a shorting insert 14 is adapted to be positioned between the components 10 and 12 and short out the contacts of component 10 until the components are fully mated, mechanically and electrically engaged and activated in the position of FIG. 1. The functioning and interrelation of these various elements will subsequently become apparent but, for the present, it should be understood that the components are preferably molded of suitable electrically non-conductive plastic material except for the various wires and contacts which will subsequently be noted as the description proceeds.

Figure 8:
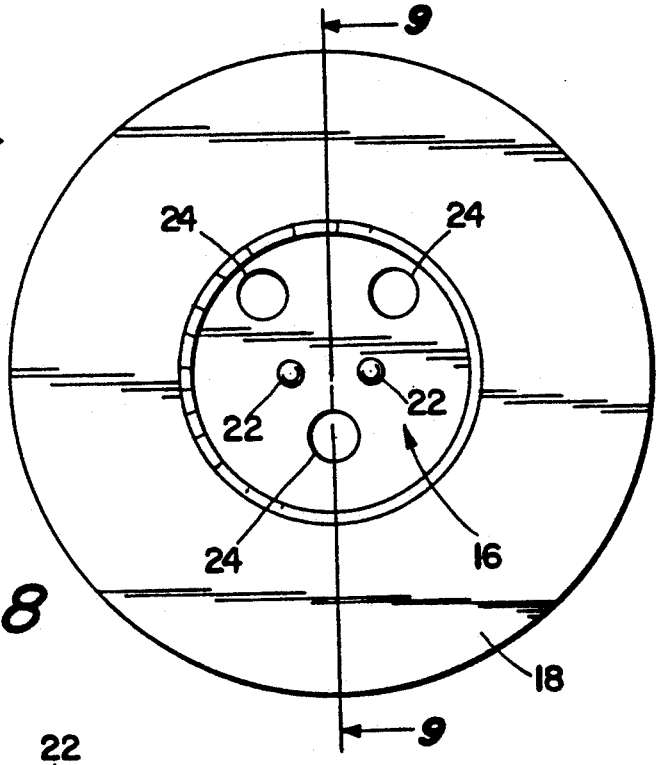
FIG. 8 is a plan view of the socket portion of the connector element (the view is taken on line 8—8 of FIG. 2)

Referring in particular to the first component 10, this component is illustrated in FIGS. 1-4 as comprising a body defining a cylindrical socket opening 16 having an upper circular flange portion 18. The body which defines the socket 16 can be directly incorporated into an associated structure, such as an igniter housing or the like. Additionally, it should be understood that it can be formed as a separate, distinct element and added to the associated structure. In any event, the body which defines socket 16 and flange 18 terminates in a bottom wall 20 from which a pair of metallic, electrically conductive male connector members or pins 22 extend. The two pins 22 are coupled in any conventional fashion to respective leads of an airbag igniter (not shown) such that the coupling of electrical energy to the igniter through the pins will cause the igniter to fire. The bottom wall 20 of the socket 16 is provided with three cylindrical recesses 24 which are located as best shown in FIG. 8. These recesses act to orient the shorting insert 14 when it is placed into the socket 16.

Figure 9:
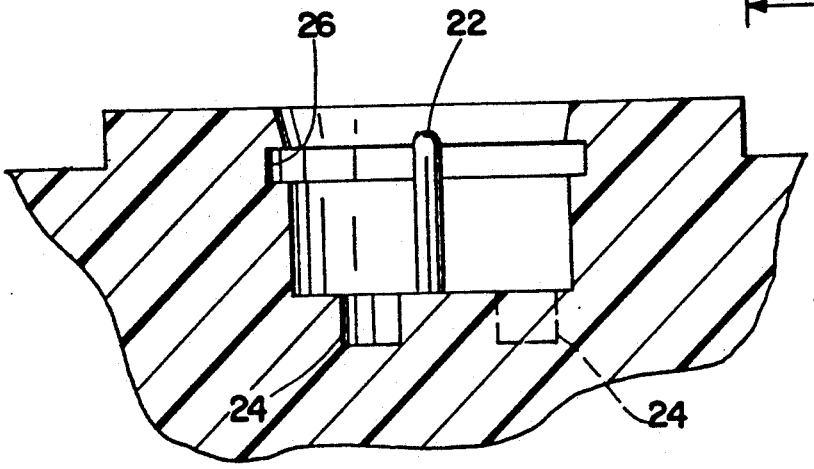
FIG. 9 is a cross-sectional view taken on line 9—9 of FIG. 8.

Extending about the upper end of the recess or socket 16 is a circumferentially continuous latch groove 26 which functions to receive corresponding latch tabs or elements on component 12. The cross-sectional shape and arrangement of the recess or groove 26 can best be seen in FIG. 9.

Figure 4:
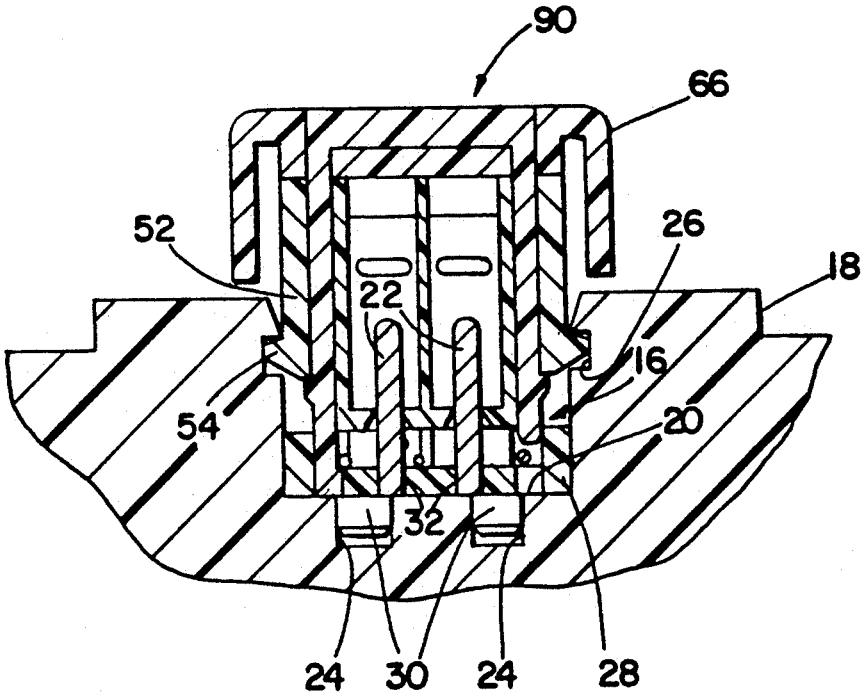
FIG. 4 is a vertical cross-sectional view taken on line 4—4 of FIG. 1A.
Figure 5:
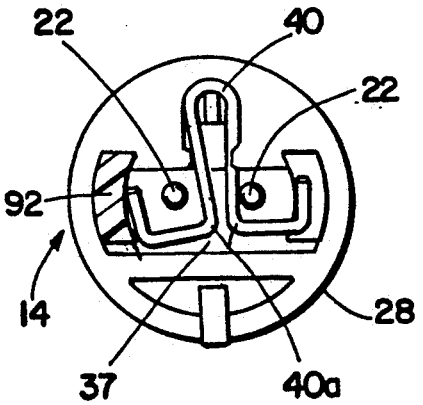
FIGS. 5, 6, and 7 are plan views of the short circuit element showing it in its activated position, its shorting position, and its neutral position, respectively.

The shorting insert 14 is, as previously mentioned, received in the socket 16 and acts to short out the male connector elements 22 by providing electrical connection therebetween when the second component 12 is not in position with the safety latch element engaged. As best seen in FIGS. 2 and 4 through 7, the shorting insert 14 comprises a relatively thin, disk-like molded plastic body 28 which is sized so as to be closely received in the socket 16. The lower surface of the body 28 is provided with short, downwardly extending cylindrical legs 30 that are positioned and sized so as to be received within the openings 24 in the bottom wall 20 of recess 16. These leg portions 30 act to assure proper orientation of the shorting insert relative to the socket 16. Additionally, as can be seen, the body 28 includes a pair of centrally located openings 32 through which the pins 22 extend as best seen in FIGS. 2 and 4.

An upwardly extending, generally rectangular tab or leg 34 is provided adjacent the left-hand side of body 28 (as viewed in FIG. 2). This leg 34 includes a laterally extending latch tab 36 at its upper end. Latch tab 36 is sized and arranged to be received within latch groove 26 to retain the body 28 in recess 16.

A centrally located, somewhat T-shaped recess 37 extends inwardly from the top surface of the body 28. Positioned within this T-shaped recess 37 and retained therein by inwardly extending molded tabs 38 is a resilient, spring metal shorting clip 40. The clip 40 includes a parallel pair of central legs 40*a* which are spaced and sized so that when the body 28 is positioned in recess 16, these leg portions 40*a* engage the lateral inner sides of the pins 22 (see FIG. 6) and complete an electric circuit therebetween to electrically short out these elements. The clip 40 further includes outer end portions 40*b* which, as best seen in FIG. 6, extend adjacent openings 42 that are of arcuate shape and which extend completely through the body 28.

Figure 6:
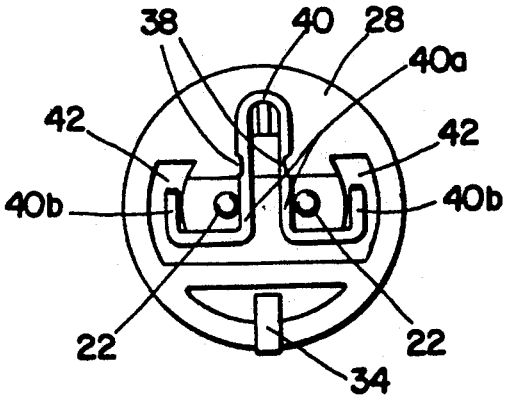
Figure 7:
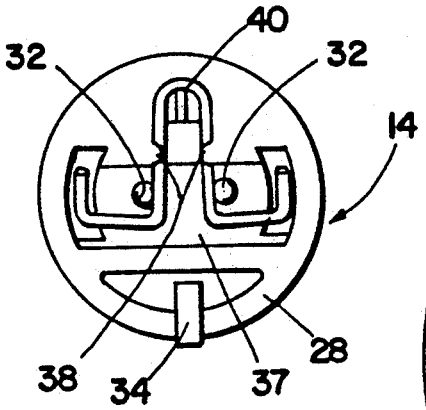

FIGS. 6 and 7 show the shorting insert 14 in the shorting position and a neutral position, respectively. As shown in FIG. 6, the insert 14 is in position in the recess 16, and the pins 22 are extending through the openings 32 in electrical engagement with the shorting clip 40 and engaging the parallel portions 40*a*. FIG. 7 shows the clip 40 in a neutral position before the body 28 is installed in the socket 16. As shown therein, the natural shape of the spring clip 40 is such as to cause it to extend with the portions 40*a* slightly over the openings 32. Thus, as it is placed into the recess 16 and properly oriented therein by the location of the openings 24, the spring clip 40 must be compressed inwardly creating good electrical contact between the clip 40 and the pins 22.

The second component 12 of the subject system can best be understood with reference to FIGS. 2, 3, 4, and 12 through 14. As illustrated therein, the component 12 includes a lower body section (see FIGS. 12 and 13) which has a plug portion 48 that extends downwardly and carries a pair of electrically conductive contacts 50 in the form of female socket elements which are electrically connected to the conductors 52. The contacts 50 are sized and arranged to receive the pins 22 of component 10.

Each contact 50 has a folded, generally L-shaped attachment section 50*a*for attachment to a corresponding one of two conductors 52. The conductors 52 are insulation-sheathed wires whose ends are stripped for electrical and mechanical joining to the attachment section of the corresponding contact. The wires are attached to the cylindrical contacts 50 in any conventional manner, usually through crimping of a portion of the attachment section 50*a* around the bare end of the wires. The conductors pass through a ferrite bead 61 disposed within a cavity 63 in the main body of plug 12. The bead 61 is a generally box-shaped solid and is pierced by two parallel, cylindrical through-holes through which the conductors 62 pass. The conductors emerge from the main body of plug 12 through openings in the rear wall of the cavity 63.

Figure 12:
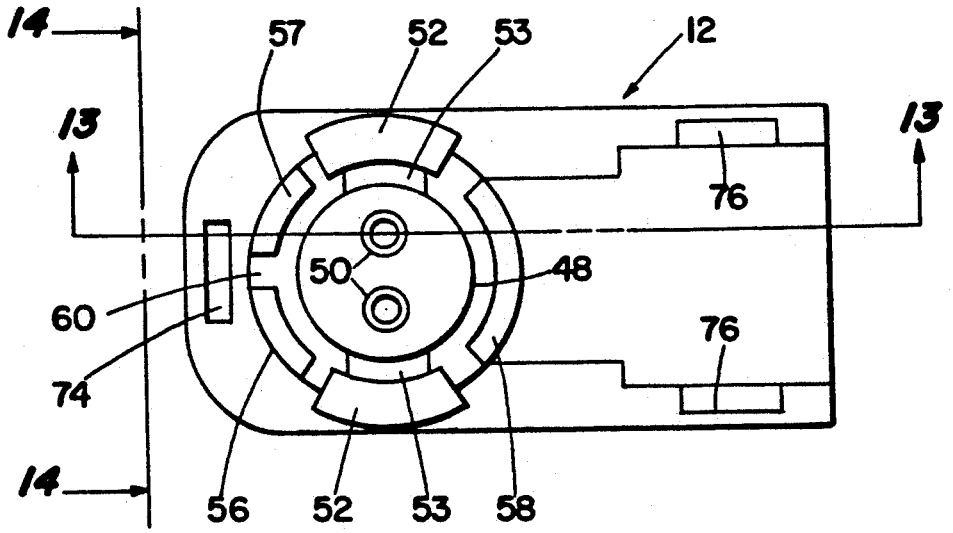
FIG. 12 is a bottom view of the second component of the subject connector system and the view is taken on line 12—12 of FIG. 2.
Figure 13:
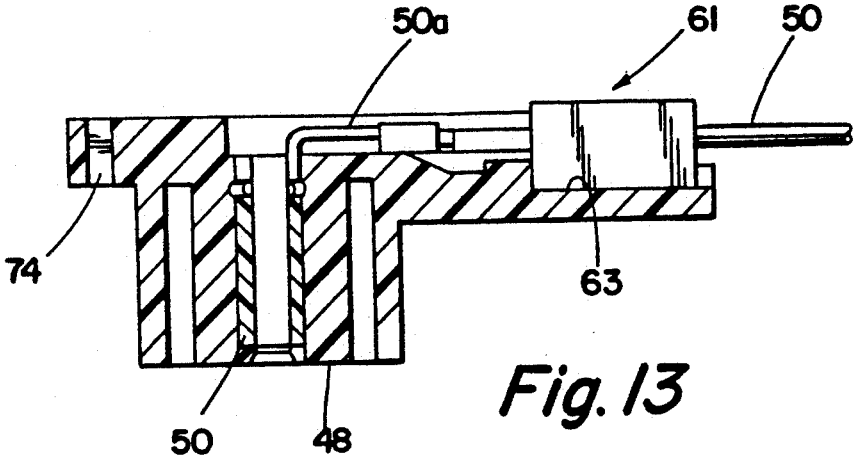
FIG. 13 is a cross-sectional view taken on line 13—13 of FIG. 12.
Figure 14:
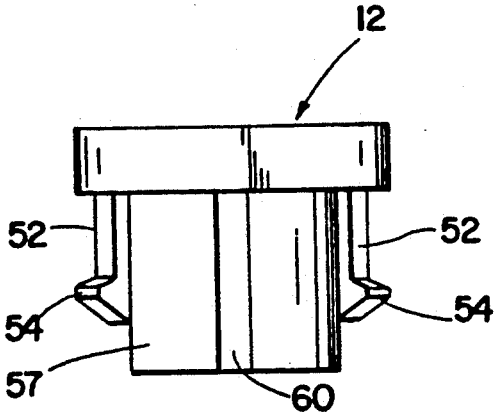
FIG. 14 is an end view taken on line 14—14 of FIG. 12.

The central plug portion 48 is generally cylindrical as best seen in FIG. 12. Positioned laterally outward on diametrically opposite sides of the plug portion 48 are a pair of arcuate resilient legs or tabs 52 which extend downwardly and carry radially outwardly extending latches 54 (see FIG. 14). As best illustrated in FIG. 4, these legs 52 and the latches 54 are sized and located so as to enter into the latch groove 26 in recess 16 when component 12 is properly mated and seated within the recess 16. Accordingly, the latch grooves receives both tabs 54 of the plug portion 48 and the latch tab 36 of the shorting insert 14 in the final assembly of the overall connector assembly.

Associated with the central portion 48 are three additional downwardly extending guide legs 56, 57, and 58. These legs are located and sized so as to closely engage the interior of the socket 16 and provide a rigid guide for locating component 12 within the socket defined by component 10. Additionally, it should be noted that the legs 56 and 57 are spaced apart a short distance as illustrated by the numeral 60. This recess or spacing 60 is sized and located so as to closely engage on the opposite sides of the upwardly extending leg 34 of the shorting insert 14 (see FIG. 2). This relationship assures that plug portion of component 12 can only be placed into component to with the proper orientation to assure correct polarization.

Figure 3:
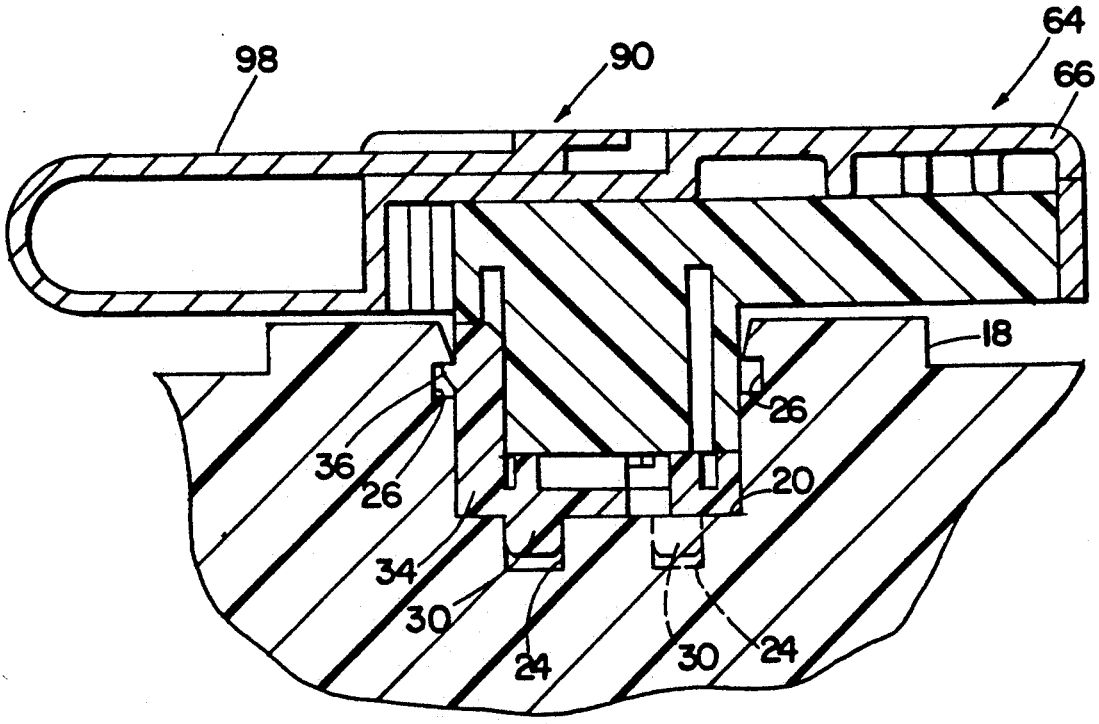
FIG. 3 is a cross-sectional elevational view taken on line 3—3 of FIG. 1A.

Component 12 further includes an upper half which encloses the lower half and provides enclosure for the leads 52 and engages them in a manner to provide strain relief. The general construction and arrangement of the upper half or cover portion 64 is best illustrated in FIGS. 3, 4, 10, and 11. As illustrated therein, it includes a main body 66 which has an opening formed in the lower side into which the lower half of the connector component 12 is received. The two halves are retained in connected position by cooperating resilient tab extensions 68 and 70 which extend downwardly from the inner wall of the inwardly extending recess 67. There are two of the tabs 68 spaced apart and provided with outwardly extending latch ends 68*a*. Likewise, there are four of the tab extensions 70 with latch ends 70*a*. These elements extend into and through a suitable opening 74 formed in the lower component (see FIGS. 12 and 13). As also can be seen by reference to FIGS. 12 and 13, the tabs 70 extend downwardly in a similar manner through openings 76 formed in the lower half of component 12. This firmly locks the two elements of component 12 in proper related engagement as illustrated in FIGS. 3 and 4.

Figure 10:
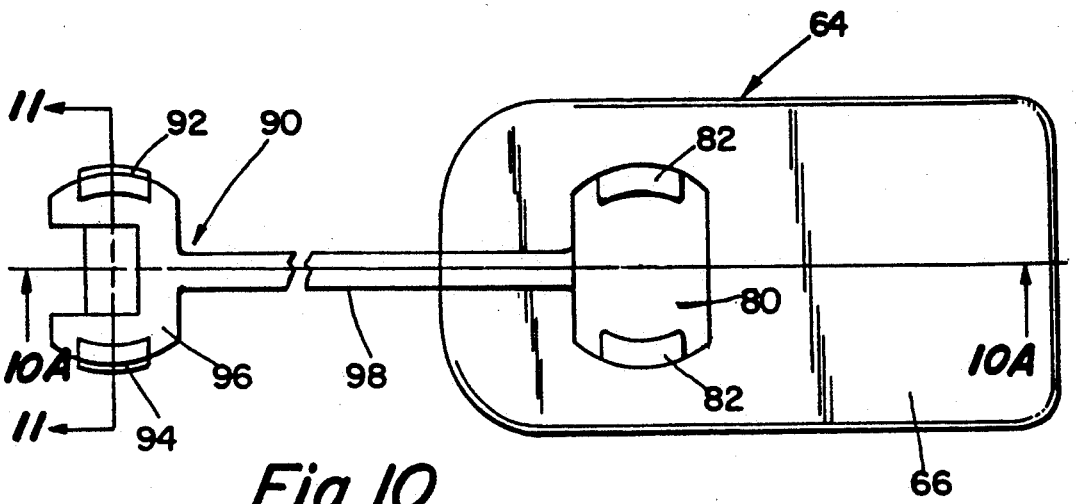
FIG. 10 is a top plan view of the second component of the connector system of the subject invention.
Figure 10A:
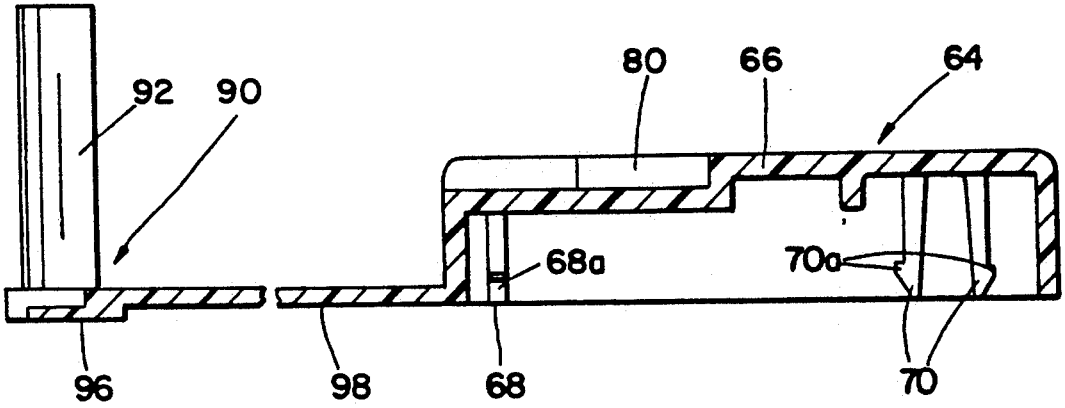
FIG. 10A is a longitudinal cross-sectional view taken on line 10A—10A of FIG. 10.
Figure 11:
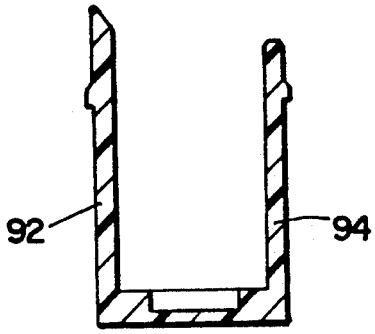
FIG. 11 is a cross-sectional view taken on line 11—11 of FIG. 10.

As best seen in FIGS. 2, 10 and 10A, the upper half of component 12 has a recess 80 which extends inwardly from the upper surface. At the ends of recess so, there are arcuately shaped through openings 82. The openings 82 are aligned with the previously-mentioned openings 42 of component 14, as well as openings 53 of the lower half of component 12. These aligned openings 82, 53, and 42 provide means for latching the components together in their mated position and also disconnecting the shorting clip 40 so as to activate the connection. Means for performing this function comprise the latch 90 seen in FIGS. 2, 10, and 11. As illustrated therein, the latch 90 comprises a pair of elongated leg-like portions 92 and 94 that are carried on a cross member 96. The member 90 is joined to the component 12 by a resilient or flexible tether or arm 98. The legs 92, 94 have a configuration, size, and spacing so as to allow them to be closely, but freely, received within the openings 82, 53, and 42 previously mentioned.

FIGS. 1A, 3, and 4 illustrate the connection assembled with the safety latch element in its inserted and latched position. As shown therein, the legs 92 and 94 extend downwardly completely through the openings previously mentioned. The leg 92 is significantly longer and extends completely to the bottom of the recess or socket 16. It is located such that in extending to the bottom of the recess, it moves the resilient shorting clip away from the left-hand pin 22 as viewed in FIG. 5. This eliminates the shorting between the two pins and actuates the connection system. As best shown in FIG. 4, the insertion of the legs 92 and 94 to their final located position shown also acts to bias the resilient locking tabs 52 into engaged position with the latch groove 26 of socket 16. Thus, with the locking latch 90 in its inserted and located position, it is impossible to remove the second component 12 from the first component 10. Only after the safety latch 90 has been removed and a short circuit between the male connector elements achieved is it possible for removal to take place. Thus, the subject system not only provides a shorting between the male connectors whenever the system is disconnected, but further assures proper polarization by requiring proper orientation of the elements during mating and also prevents inadvertent disconnection of the system and assures that disconnection can only take place after a shorting of the male connectors has been achieved.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An electrical connection including:

a) a first component carrying a first pair of electrical connector elements;

b) a second component releasably mated with the first component and carrying a second pair of electrical connector elements engaged with the first pair of electrical connector elements;

c) a shorting element for electrically shorting the first pair of electrical connector elements;

d) a safety latch element selectively receivable in a latch position for moving the shorting element to a non-shorting position when the second component is mated with the first component; and, e) lock means actuated by the safety latch element for preventing separation of the first and second components while the safety latch element is in the latch position.

2. An electrical connection as defined in claim 1 wherein the second component carries the lock means.

3. An electrical connection as defined in claim 2 wherein the lock means includes a lock element which is moved into locking engagement with the first component when the safety latch element is in its latch position.

4. An electrical connection as defined in claim 1 wherein the shorting element comprises a resilient clip which extends between the first pair of electrical connector elements.

5. An electrical connection as defined in claim 4 wherein the safety latch element includes means for engaging the shorting element when in said latch position and moving said shorting element out of contact with at least one of said first pair of electrical connector elements thereby electrically opening said first pair of connector elements.

6. An electrical connection as defined in claim 5 wherein the lock means includes a resilient element which is deflected into locking engagement by the safety latch element when the safety latch element is in latch position.

7. An electrical connection as defined in claim 6 wherein the resilient element extends from the second component and wherein the safety latch element when in the latch position extends through the first component.

8. An electrical connection as defined in claim 1 wherein the first component comprises a socket into which the second component extends.

9. An electrical connection as defined in claim 8 wherein the safety latch extends into the second component when in a latch position, and wherein the lock means includes a resilient element which is biased laterally into locking engagement with the socket when the safety latch is in the latch position.

10. An electrical connection including:

a) a first component carrying a male connector element;

b) a second component releasably mated with the first component and carrying a female connector element engaged with the male connector element;

c) a shorting element biased for electrically connecting the male connector element to a first electrical potential;

d) a safety latch element selectively positionable in a latch position when the second component is mated with the first component;

e) means on said safety latch element for selectively urging said shorting element against said bias and electrically disconnecting said male connector element from said first electrical potential when in said latch position; and, f) lock means actuated by the safety latch element for preventing separation of the first and second components while the safety latch element is in the latch position.

11. An electrical connection as defined in claim 10 wherein the second component carries the lock means.

12. An electrical connection as defined in claim 10 wherein the safety latch element includes tab portions that maintain portions of the second component in engagement with the first component.

13. An electrical connection as defined in claim 12 wherein the safety latch element extends into the second element when in the latch position.

14. An electrical connection as defined in claim 10 wherein the first component includes a socket which receives the first component.

15. An electrical connection as defined in claim 14 wherein the second component includes resilient first portions that engage in recesses formed in the socket.

16. An electrical connection as defined in claim 15 wherein the safety latch element when in the latch position prevents the resilient first portions from disengaging from the recesses in the socket.

17. An electrical connection including:

a) a first component carrying a first electrical connector element;

b) a second component releasably mounted with the first component and carrying a second electrical connector element engaged with the first electrical connector element;

c) a shorting element for electrically connecting the first electrical connector element to a first electrical potential;

d) a safety latch element selectively receivable in a latch position for moving the shorting element to disconnect the first electrical connector from the first electrical potential when the second component is mated with the first component; and e) lock means actuated by the safety latch element for preventing separation of the first and second components while the safety latch is in the latch position.

* * * * *